US008428956B2

(12) United States Patent
Yoshida

(10) Patent No.: US 8,428,956 B2
(45) Date of Patent: Apr. 23, 2013

(54) AUDIO ENCODING DEVICE AND AUDIO ENCODING METHOD

(75) Inventor: Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 948 days.

(21) Appl. No.: 11/912,522

(22) PCT Filed: Apr. 27, 2006

(86) PCT No.: PCT/JP2006/308813

§ 371 (c)(1),
(2), (4) Date: Oct. 25, 2007

(87) PCT Pub. No.: WO2006/118179

PCT Pub. Date: Nov. 9, 2006

(65) Prior Publication Data

US 2009/0083041 A1 Mar. 26, 2009

(30) Foreign Application Priority Data

Apr. 28, 2005 (JP) ..... 2005-132366

(51) Int. Cl.
*G10L 19/00* (2006.01)
*G10L 21/04* (2006.01)

(52) U.S. Cl.
USPC ..... 704/500; 704/501; 704/502; 704/503; 704/504; 704/216; 704/219

(58) Field of Classification Search ..... 704/500, 704/501, 502, 503, 504, 216, 219; 381/23.1, 381/17; 700/94
See application file for complete search history.

(56) References Cited

U.S. PATENT DOCUMENTS 5,274,740 A * 12/1993 Davis et al. ..... 704/203
5,285,498 A 2/1994 Johnston
5,434,948 A 7/1995 Holt et al.
5,481,614 A 1/1996 Johnston
5,924,062 A * 7/1999 Maung ..... 704/219

(Continued)

FOREIGN PATENT DOCUMENTS

JP 6-075590 3/1994
JP 10-105193 4/1998

(Continued)

OTHER PUBLICATIONS

ISO/IEC 14496-3, "Information Technology—Coding o fAudio-Visual Obj ects-Part 3: Audio," pp. 304-305 (Section 4.B. 14:Scalable AAC with core coder), Dec. 2001.*

(Continued)

*Primary Examiner* — Edgar Guerra-Erazo
(74) *Attorney, Agent, or Firm* — Greenblum & Bernstein, P.L.C.

(57) ABSTRACT

There is provided an audio encoding device capable of effectively encoding a stereo audio even when a correlation between channels of the stereo audio is small. In the device, a monaural signal generation unit (110) generates a monaural signal by using a first channel signal and a second channel signal contained in the stereo signal. An encoding channel selection unit (120) selects one of the first channel signal and the second channel signal. An encoding unit including a monaural signal encoding unit (112), a first channel encoding unit (122), a second channel encoding unit (124), and a switching unit (126) encodes the generated monaural signal to obtain core-layer encoded data and encodes the selected channel signal to obtain extended layer encoded data corresponding to the core-layer encoded data.

12 Claims, 11 Drawing Sheets

U.S. PATENT DOCUMENTS

| | | | | |
|---|---|---|---|---|
| 6,122,338 | A | 9/2000 | Yamauchi | |
| 6,341,165 | B1 * | 1/2002 | Gbur et al. | 381/23 |
| 6,356,211 | B1 | 3/2002 | Shimoyoshi et al. | |
| 6,360,200 | B1 * | 3/2002 | Edler et al. | 704/219 |
| 6,393,392 | B1 * | 5/2002 | Minde | 704/220 |
| 6,529,604 | B1 | 3/2003 | Park et al. | |
| 6,539,357 | B1 | 3/2003 | Sinha | |
| 6,629,078 | B1 * | 9/2003 | Grill et al. | 704/500 |
| 6,741,965 | B1 | 5/2004 | Shimoyoshi et al. | |
| 6,961,432 | B1 | 11/2005 | Sinha et al. | |
| 7,050,972 | B2 * | 5/2006 | Henn et al. | 704/228 |
| 7,062,429 | B2 * | 6/2006 | Faller | 704/200.1 |
| 7,277,849 | B2 * | 10/2007 | Streich et al. | 704/229 |
| 7,283,957 | B2 * | 10/2007 | Minde et al. | 704/229 |
| 7,394,903 | B2 * | 7/2008 | Herre et al. | 381/23 |
| 7,447,317 | B2 * | 11/2008 | Herre et al. | 381/23 |
| 7,742,912 | B2 * | 6/2010 | Den Brinker | 704/200.1 |
| 7,904,292 | B2 * | 3/2011 | Goto et al. | 704/219 |
| 8,078,475 | B2 * | 12/2011 | Tsushima | 704/500 |
| 2002/0022898 | A1 * | 2/2002 | Araki | 700/94 |
| 2002/0154041 | A1 | 10/2002 | Suzuki et al. | |
| 2003/0014136 | A1 * | 1/2003 | Wang et al. | 700/94 |
| 2003/0191635 | A1 | 10/2003 | Minde et al. | |
| 2003/0231799 | A1 * | 12/2003 | Schmidt | 382/244 |
| 2004/0109471 | A1 * | 6/2004 | Minde et al. | 370/465 |
| 2005/0075871 | A1 * | 4/2005 | Youn | 704/229 |
| 2005/0216262 | A1 * | 9/2005 | Fejzo | 704/217 |
| 2008/0215317 | A1 * | 9/2008 | Fejzo | 704/217 |
| 2009/0028240 | A1 * | 1/2009 | Huang et al. | 375/240.12 |
| 2010/0023575 | A1 * | 1/2010 | Choo et al. | 708/607 |
| 2010/0153118 | A1 * | 6/2010 | Hotho et al. | 704/500 |

FOREIGN PATENT DOCUMENTS

| | | |
|---|---|---|
| JP | 11-032399 | 2/1999 |
| JP | 11-317672 | 11/1999 |
| JP | 2001-209399 | 8/2001 |
| JP | 2001-255892 | 9/2001 |
| JP | 2002-244698 | 8/2002 |
| JP | 2004-301954 | 10/2004 |
| WO | 98/46045 | 10/1998 |
| WO | 02/23529 | 3/2002 |

OTHER PUBLICATIONS

Bosi "Multichannel Audio Coding' and Its Applications in DAB and DVB", Signal Processing Proceding, 2000,WCCC-ICSP 2000, 5th International conference, vol. 1, pp. 1-10.*

Ramprashad, S.A.;, "Stereophonic CELP coding using cross channel prediction," Speech Coding, 2000. Proceedings. 2000 IEEE Workshop on, vol., No., pp. 136-138, 2000.*

"Hans, M.; et al."Lossless Compression of Digital Audio. IEEE Signal Processing Magazine, vol. 18, No. 4. pp. 21-32 (Jul. 2001 ).*

Fejzo, Zoran; Kramer, Lorr; Mcdowell, Keith; Yee, Dilbert: "DTS-HD: Technical Overview of Lossless Mode of Operation", 118th AES Convention, May 28, 2005.*

Ramprashad, "Stereophonic CELP coding using cross channel prediction," Proc. IEEE Workshop on Speech Coding, pp. 136-138, Sep. 2000.

U.S. Appl. No. 11/912,357 to Yoshida, which was filed on Oct. 23, 2007.

Liebchen, "Lossless Audio Coding using Adaptive Multichannel Prediction," Internet Citation [Online], Oct. 5, 2002, XP002466533, Retrieved from the Internet: URL:http://www.nue.tu-berlin.de/publications/papers/aes113.pdf [retrieved on Jan. 19, 2008].

* cited by examiner

AUDIO ENCODING DEVICE AND AUDIO ENCODING METHOD

TECHNICAL FIELD

The present invention relates to a speech coding apparatus and a speech coding method. More particularly, the present invention relates to a speech coding apparatus and a speech coding method for stereo speech.

BACKGROUND ART

As broadband transmission in mobile communication and IP communication has become the norm and services in such communications have diversified, high sound quality of and higher-fidelity speech communication is demanded. For example, from now on, hands free speech communication in a video telephone service, speech communication in video conferencing, multi-point speech communication where a number of callers hold a conversation simultaneously at a number of different locations and speech communication capable of transmitting the background sound without losing high-fidelity will be expected to be demanded. In this case, it is preferred to implement speech communication by stereo speech which has higher-fidelity than using a monaural signal, is capable of recognizing positions where a number of callers are talking. To implement speech communication using a stereo signal, stereo speech encoding is essential.

Further, to implement traffic control and multicast communication in speech data communication over an IP network, speech encoding employing a scalable configuration is preferred. A scalable configuration includes a configuration capable of decoding speech data even from fragmentary encoded data at the receiving side. Coding processing in a speech coding scheme employing a scalable configuration is layered, providing a layer for the core layer and a layer for the enhancement layer. Consequently, encoded data generated by this coding processing includes encoded data of the core layer and encoded data of the enhancement layer.

As a result, even when encoding and transmitting stereo speech, it is preferable to implement encoding employing a monaural-stereo scalable configuration where it is possible to select decoding a stereo signal and decoding a monaural signal using part of coded data at the receiving side.

Speech coding methods employing a monaural-stereo scalable configuration include, for example, predicting signals between channels (abbreviated appropriately as "ch") (predicting a second channel signal from a first channel signal or predicting the first channel signal from the second channel signal) using pitch prediction between channels, that is, performing encoding utilizing correlation between 2 channels (see Non-Patent Document 1).

Non-patent document 1: Ramprashad, S. A., "Stereophonic CELP coding using cross channel prediction", Proc. IEEE Workshop on Speech Coding, pp. 136-138, September 2000.

DISCLOSURE OF INVENTION

Problems to be Solved by the Invention

However, in the speech coding methods of the related art described above, there are cases where a sufficient prediction performance (prediction gain) cannot be obtained and coding efficiency deteriorates when correlation between both channels is small.

It is therefore an object of the present invention to provide speech coding apparatus and a speech coding method capable of effectively coding stereo speech even when correlation between both channels is small.

Means for Solving the Problem

The speech coding apparatus of the present invention encodes a stereo signal comprising a first channel signal and a second channel signal, and employs a configuration having: a monaural signal generating section that generates a monaural signal using the first channel signal and the second channel signal; a selecting section that selects one of the first channel signal and the second channel signal; and a coding section that encodes the generated monaural signal to obtain core layer encoded data, and encodes the selected channel signal to obtain enhancement layer encoded data corresponding to the core layer encoded data.

The speech coding method of the present invention for encoding a stereo signal comprising a first channel signal and a second channel signal, includes the steps of: generating a monaural signal using the first channel signal and the second channel signal; selecting one of the first channel signal and the second channel signal; and encoding a generated monaural signal to obtain core layer encoded data and encoding a selected channel signal to obtain enhancement layer encoded data corresponding to the core layer encoded data.

Advantageous Effect of the Invention

The present invention can encode stereo speech effectively when correlation between a plurality of channel signals of stereo speech signals is low.

BEST MODE FOR CARRYING OUT THE INVENTION

The following is a detailed description with reference to the appended drawings of embodiments of the present invention relating to speech coding with a monaural-stereo scalable configuration.

Embodiment 1

Figure 1:
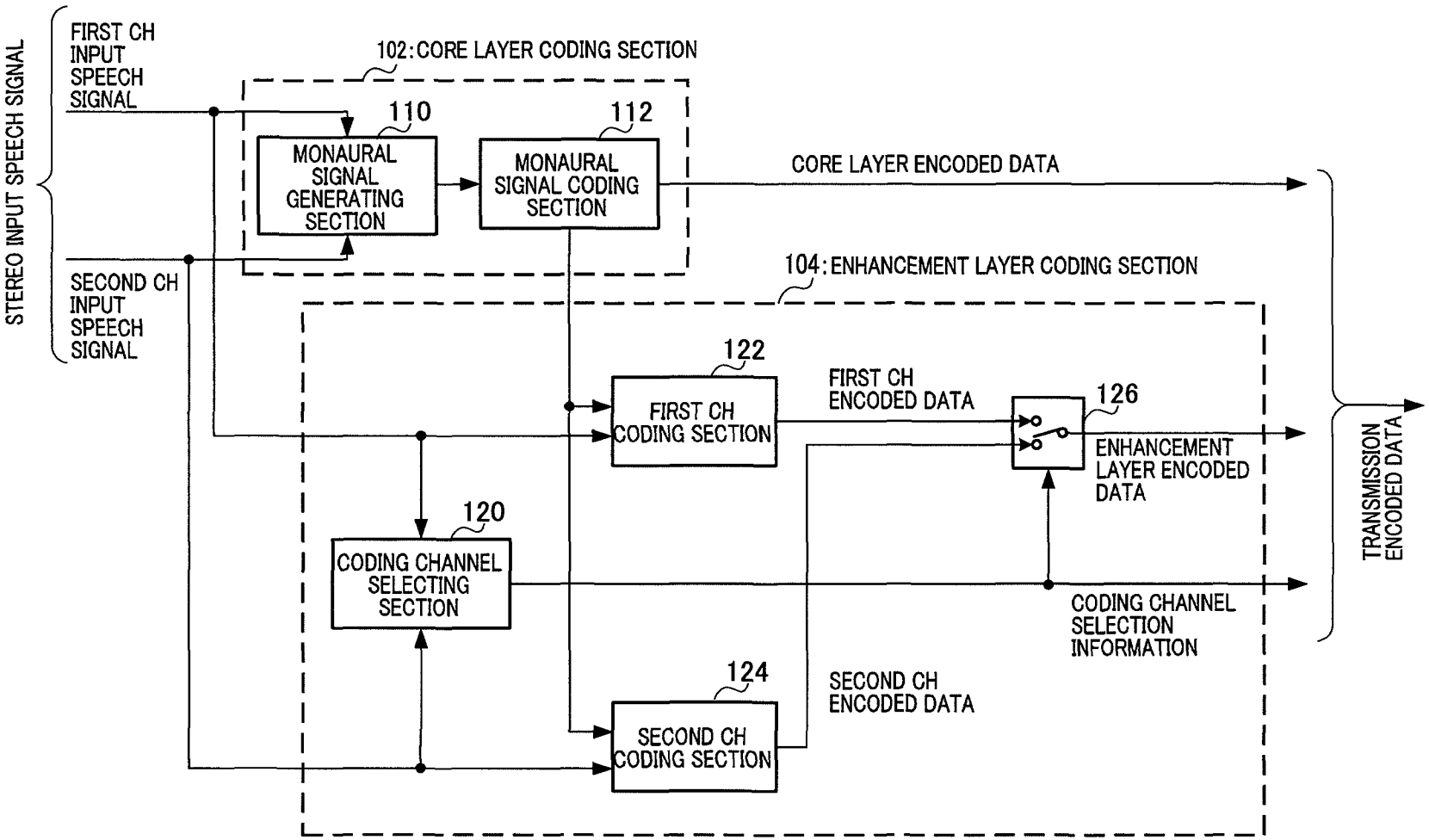
FIG. 1 is a block diagram showing a configuration of speech coding apparatus according to Embodiment 1 of the present invention.

FIG. 1 is a block diagram showing a configuration of speech coding apparatus according to Embodiment 1 of the present invention. Speech coding apparatus 100 of FIG. 1 is comprised of core layer coding section 102 that is a component corresponding to the core layer of a scalable configuration, and enhancement layer coding section 104 that is a component corresponding to the enhancement layer of a scalable configuration. The following is a description assuming that each component operates in frame units.

Core layer coding section 102 has monaural signal generating section 110 and monaural signal coding section 112. Further, enhancement layer coding section 104 is comprised of coding channel selecting section 120, first ch coding section 122, second ch coding section 124 and switching section 126.

At core layer coding section 102, monaural signal generating section 110 generates monaural signal s_mono(n) based on the relationship shown in equation 1 from first ch input speech signal s_ch1(*n*) and second ch input speech signal s_ch2(*n*) (where n=0 to NF-1; and NF is frame length) contained in a stereo input speech signal. The stereo signal described in this embodiment is comprised of two channel signals (i.e. a first channel signal and a second channel signal).

[1]

$$s_mono(n) = \frac{s_ch1(n) + s_ch2(n)}{2} \quad \text{(Equation 1)}$$

Monaural signal coding section 112 encodes monaural signal s_mono(n) every frame. An arbitrary coding scheme may be used in this encoding. Coded data obtained as a result of encoding monaural signal s_mono (n) is outputted as core layer encoded data. More specifically, core layer encoded data is multiplexed with enhancement layer encoded data and coding channel selection information described later and outputted from speech coding apparatus 100 as coded transmission data.

Further, monaural signal coding section 112 decodes monaural signal s_mono(n) and outputs the resulting monaural decoded speech signal to first ch coding section 122 and second ch coding section 124 of enhancement layer coding section 104.

At enhancement layer coding section 104, coding channel selecting section 120 selects an optimum channel of the first and second channels as a channel to be subject to enhancement layer coding based on a predetermined selection criterion using first ch input speech signal s_ch1(*n*) and second ch input speech signal s_ch2(*n*). The optimum channel is selected every frame. Here, the predetermined selection criterion is a reference for implementing enhancement layer coding at high efficiency or high sound quality (low coding distortion). Coding channel selecting section 120 generates coding channel selection information indicating selected channels. Generated coding channel selection information is outputted to switching section 126 and is multiplexed with core layer encoded data (described earlier) and enhancement layer encoded data (described later).

Coding channel selecting section 120 may also use arbitrary parameters, signals, or coding results (i.e. first ch encoded data and second ch encoded data described later) obtained in coding processes at first ch coding section 122 and second ch coding section 124 rather than using first input speech signal s_ch1(*n*) and second input speech signal s_ch2(*n*).

First ch coding section 122 encodes the first ch input speech signal every frame using the first ch input speech signal and the monaural decoded speech signal, and outputs first ch encoded data obtained as a result to switching section 126.

Further, first ch coding section 122 decodes first ch encoded data and obtains a first ch decoded speech signal. In this embodiment, a first ch decoded speech signal obtained by first ch coding section 122 is omitted from the drawings.

Second ch coding section 124 encodes the second ch input speech signal every frame using the second ch input speech signal and the monaural decoded speech signal and outputs second ch encoded data obtained as a result to switching section 126.

Further, second ch coding section 124 decodes second ch encoded data and obtains a second ch decoded speech signal. In this embodiment, a second ch decoded speech signal obtained by second ch coding section 124 is omitted from the drawings.

Switching section 126 selectively outputs one of first ch encoded data and second ch encoded data every frame in accordance with coding channel selection information. Outputted encoded data is encoded data for channels selected by coding channel selecting section 120. As a result, when the selected channel is switched over from the first channel to the second channel, or from the second channel to the first channel, encoded data outputted by switching section 126 also changes from first ch encoded data to second ch encoded data or from second ch encoded data to first ch encoded data.

Here, a combination of monaural signal coding section 112, first ch coding section 122, second ch coding section 124 and switching section 126 described above together constitute a coding section that encodes a monaural signal to obtain core layer encoded data, encodes the selected channel signal, and obtains enhancement layer encoded data corresponding to the core layer encoded data.

Figure 2:
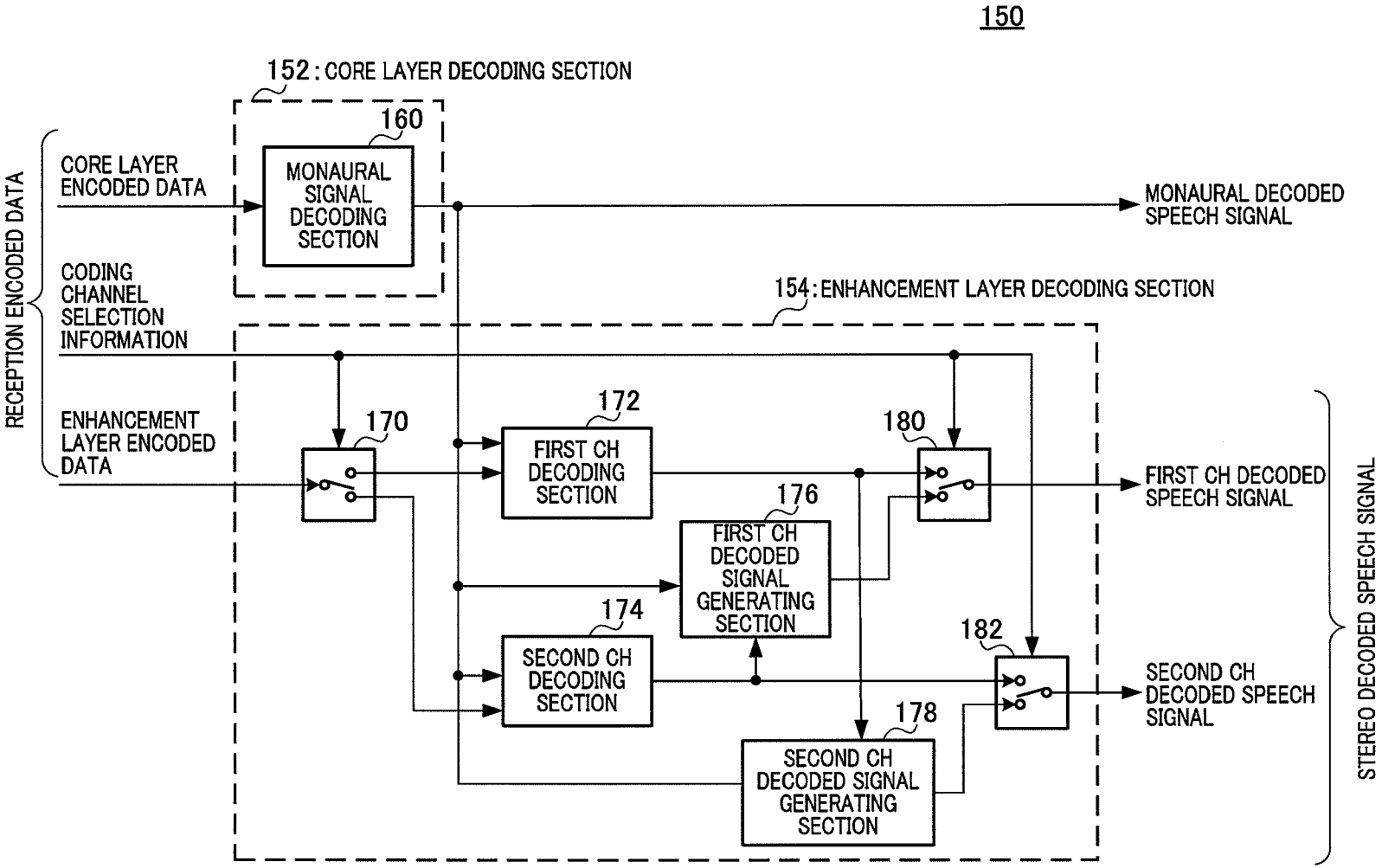
FIG. 2 is a block diagram showing a configuration of speech decoding apparatus according to Embodiment 1 of the present invention.

FIG. 2 is a block diagram showing a configuration of speech decoding apparatus capable of receiving and decoding transmitted coded data outputted by speech coding apparatus 100 as received coded data and obtaining a monaural decoded speech signal and a stereo decoded speech signal. Speech decoding apparatus 150 of FIG. 2 is comprised of core layer decoding section 152 that is a component corresponding to a core layer of a scalable configuration, and enhancement layer decoding section 154 that is a component corresponding to an enhancement layer of a scalable configuration.

Core layer decoding section 152 has monaural signal decoding section 160. Monaural signal decoding section 160 decodes core layer encoded data contained in received coded data to obtain monaural decoded speech signal sd_mono(n). Monaural decoded speech signal sd_mono (n) is then outputted to a subsequent speech output section (not shown), first ch decoding section 172, second ch decoding section 174, first ch decoded signal generating section 176 and second ch decoded signal generating section 178.

Enhancement layer decoding section 154 is comprised of switching section 170, first ch decoding section 172, second ch decoding section 174, first ch decoded signal generating section 176, second ch decoded signal generating section 178, switching section 180 and switching section 182.

Switching section 170 refers to coding channel selection information contained in received coded data and outputs enhancement layer encoded data contained in the received coded data to a decoding section corresponding to the selected channel. Specifically, when the selected channel is a first channel, enhancement layer encoded data is outputted to first ch decoding section 172, and, when the selected channel is a second channel, enhancement layer encoded data is outputted to second ch decoding section 174.

When enhancement layer encoded data is inputted from switching section 170 to first ch decoding section 172, first ch decoding section 172 decodes first ch decoded speech signal sd_ch1(*n*) using this enhancement layer encoded data and monaural decoded speech signal sd_mono(n) and outputs first ch decoded speech signal sd_ch1(*n*) to switching section 180 and second ch decoded signal generating section 178.

When enhancement layer encoded data is inputted from switching section 170 to second ch decoding section 174, second ch decoding section 174 decodes second ch decoded speech signal sd_ch2(*n*) using this enhancement layer encoded data and monaural decoded speech signal sd_mono (n) and outputs second ch decoded speech signal sd_ch2(*n*) to switching section 182 and first ch decoded signal generating section 176.

When second ch decoded speech signal sd_ch2(*n*) is inputted from second ch decoding section 174, first ch decoded signal generating section 176 generates first ch decoded speech signal sd_ch1(*n*) based on the relationship shown in the following equation 2 using second ch decoded speech signal sd_ch2(*n*) and monaural decoded speech signal sd_mono(n) inputted from second ch decoding section 174. The generated first ch decoded speech signal sd_ch1(*n*) is outputted to switching section 180.

(Equation 2)

$$sd_ch1(n)=2\times sd_mono(n)-sd_ch2(n) \quad [2]$$

When first ch decoded speech signal sd_ch1(*n*) is inputted from first ch decoding section 172, second ch decoded signal generating section 178 generates second ch decoded speech signal sd_ch2(*n*) based on the relationship shown in the following equation 3 using first ch decoded speech signal sd_ch1(*n*) and monaural decoded speech signal sd_mono (n) inputted from first ch decoding section 172. The generated second ch decoded speech signal sd_ch2(*n*) is outputted to switching section 182.

(Equation 3)

$$sd_ch2(n)=2\times sd_mono(n)-sd_ch1(n) \quad [3]$$

Switching section 180 selectively outputs one of first ch decoded speech signal sd_ch1(*n*) inputted by first ch decoding section 172 and first ch decoded speech signal sd_ch1(*n*) inputted by first ch decoded signal generating section 176 in accordance with coding channel selection information. Specifically, when the selected channel is the first channel, first ch decoded speech signal sd_ch1(*n*) inputted by first ch decoding section 172 is selected and outputted. On the other hand, when the selected channel is the second channel, first ch decoded speech signal sd_ch1(*n*) inputted by first ch decoded signal generating section 176 is selected and outputted.

Switching section 182 selectively outputs one of second ch decoded speech signal sd_ch2(*n*) inputted by second ch decoding section 174 and second ch decoded speech signal sd_ch2(*n*) inputted by second ch decoded signal generating section 178 in accordance with coding channel selection information. Specifically, when the selected channel is the first channel, second ch decoded speech signal sd_ch2(*n*) inputted by second ch decoded signal generating section 178 is selected and outputted. On the other hand, when the selected channel is the second channel, second ch decoded speech signal sd_ch2(*n*) inputted by second ch decoding section 174 is selected and outputted.

First ch decoded speech signal sd_ch1(*n*) outputted by switching section 180 and second ch decoded speech signal sd_ch2(*n*) outputted by switching section 182 are outputted to a subsequent speech outputting section (not shown) as a stereo decoded speech signal.

In this way, according to this embodiment, monaural signal s_mono(n) generated from first ch input speech signal s_ch1(*n*) and second ch input speech signal s_ch2(*n*) is encoded so as to obtain core layer encoded data, and an input speech signal (first ch inputted speech signal s_ch1(*n*) or second ch inputted speech signal s_ch2(*n*)) for a channel selected from the first channel and the second channel is encoded so as to obtain enhancement layer encoded data, so that it is possible to avoid prediction performance (prediction gain) being insufficient when correlation between a plurality of channels of a stereo signal is small and enable efficient stereo speech coding.

Embodiment 2

Figure 3:
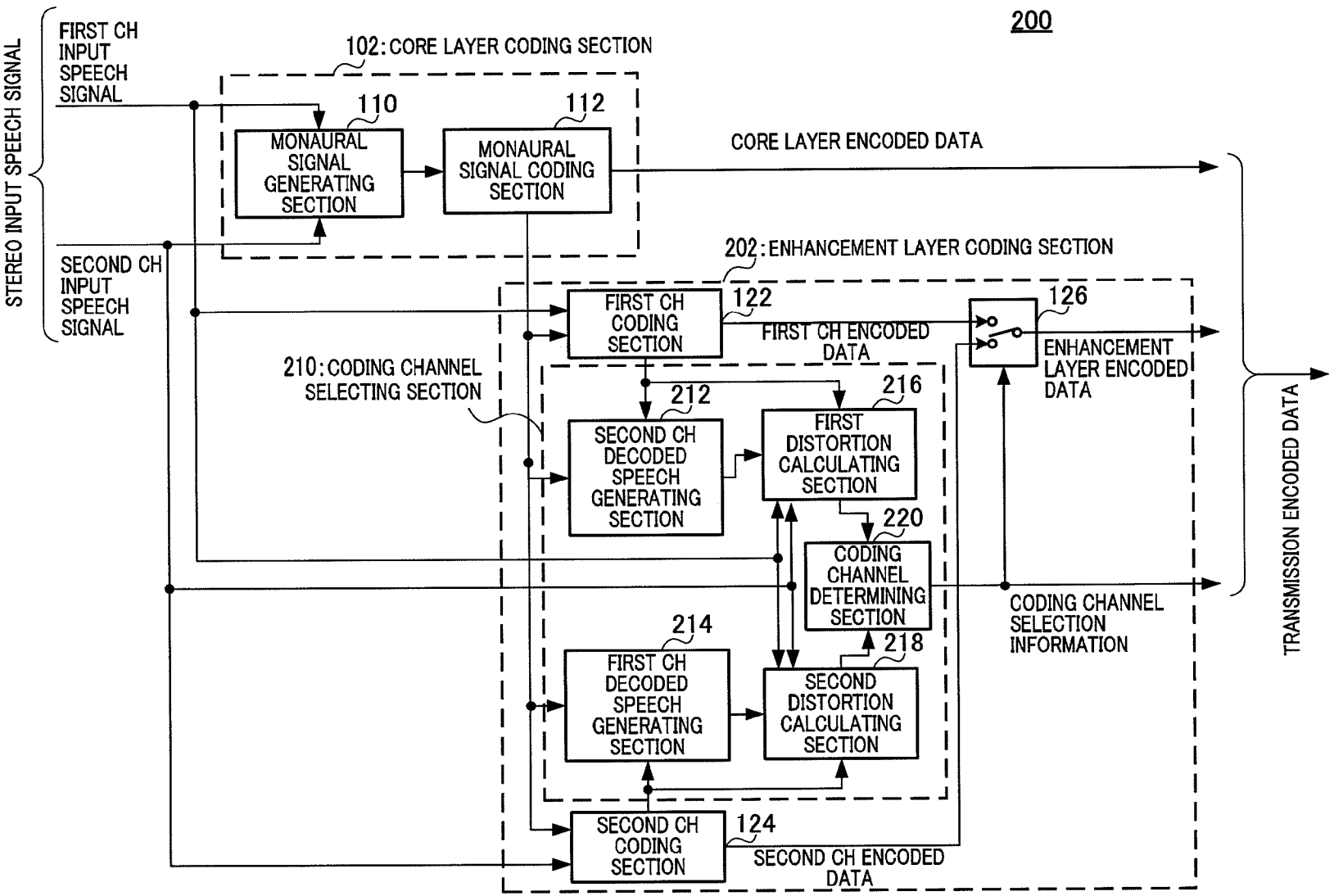
FIG. 3 is a block diagram showing a configuration of speech coding apparatus according to Embodiment 2 of the present invention.

FIG. 3 is a block diagram showing a configuration of speech coding apparatus according to Embodiment 2 of the present invention.

Speech coding apparatus 200 of FIG. 3 has basically the same configuration as speech coding apparatus 100 described in Embodiment 1. Elements of this configuration described in this embodiment that are the same as described for Embodiment 1 are given the same reference numerals as are used in Embodiment 1 and are not described in detail.

Further, transmitted coded data sent from speech coding apparatus 200 can be decoded by speech decoding apparatus having the same basic configuration as speech decoding apparatus 150 described in Embodiment 1.

Speech coding apparatus 200 is equipped with core layer coding section 102 and enhancement layer coding section 202. Enhancement layer coding section 202 is comprised of first ch coding section 122, second ch coding section 124, switching section 126 and coding channel selecting section 210.

Coding channel selecting section 210 is comprised of second ch decoded speech generating section 212, first ch decoded speech generating section 214, first distortion calculating section 216, second distortion calculating section 218 and coding channel determining section 220.

Second ch decoded speech generating section 212 generates a second ch decoded speech signal as a second ch estimation signal based on the relationship shown in equation 1 above using a monaural decoded speech signal obtained by monaural signal coding section 112 and first ch decoded speech signal obtained by first ch coding section 122. The generated second ch decoded speech signal is then outputted to first distortion calculating section 216.

First ch decoded speech generating section 214 generates a first ch decoded speech signal as a first ch estimation signal based on the relationship shown in equation 1 above using a monaural decoded speech signal obtained by monaural signal coding section 112 and second ch decoded speech signal obtained by second ch coding section 124. The generated first ch decoded speech signal is then outputted to second distortion calculating section 218.

The combination of second ch decoded speech generating section 212 and first ch decoded speech generating section 214 constitutes an estimated signal generating section.

First distortion calculating section 216 calculates first coding distortion using a first ch decoded speech signal obtained by first ch coding section 122 and a second ch decoded speech signal obtained by second ch decoded speech generating section 212. First coding distortion corresponds to coding distortion for two channels occurring when a first channel is selected as a target channel for enhancement layer coding. Calculated first coding distortion is outputted to coding channel determining section 220.

Second distortion calculating section 218 calculates first coding distortion using a first ch decoded speech signal obtained by second ch coding section 124 and a first ch decoded speech signal obtained by first ch decoded speech generating section 214. Second coding distortion corresponds to coding distortion for two channels occurring when a second channel is selected as a target channel for coding at the enhancement layer. Calculated second coding distortion is outputted to coding channel determining section 220.

Here, for example, the following two methods are given as methods for calculating coding distortion for two channels (first coding distortion or second coding distortion). In one method, an average for two channels for an error power ratio (signal to coding distortion ratio) with respect to a corresponding input speech signal (first ch input speech signal or second ch input speech signal) for decoded speech signals for each channel (first ch decoded speech signal or second ch decoded speech signal) is obtained as coding distortion for two channels. In the other method, a total for two channels of the aforementioned error power is obtained as coding distortion for two channels.

The combination of the first distortion calculating section 216 and the second distortion calculating section 218 constitutes a distortion calculating section. Further, the combination of this distortion calculating section and the prediction signal generating section described above constitutes a calculating section.

Coding channel determining section 220 compares the value of the first coding distortion and the value of the second coding distortion, and selects the one of the first coding distortion and second coding distortion having the smaller value. Coding channel determining section 220 selects a channel corresponding to the selected coding distortion as a target channel for coding at the enhancement layer (coding channel) and generates coding channel selection information indicating the selected channel. More specifically, coding channel determining section 220 selects the first channel when first coding distortion is smaller than second coding distortion, and selects the second channel when the second coding distortion is smaller than the first coding distortion. Generated coding channel selection information is outputted to switching section 126 and is multiplexed with core layer encoded data and enhancement layer encoded data.

In this way, according to this embodiment, the magnitude of coding distortion is used as a coding channel selection criterion, so that it is possible to reduce coding distortion of the enhancement layer and enable efficient stereo speech coding.

In this embodiment, a ratio or total of error power of a decoded speech signal for each channel with respect to a corresponding inputted speech signal is calculated and the results of this calculation are used as coding distortion but it is also possible to use coding distortion obtained in steps for coding at first ch coding section 122 and second ch coding section 124 in place of this. Further, this coding distortion may also be a distortion with perceptual weight.

Embodiment 3

Figure 4:
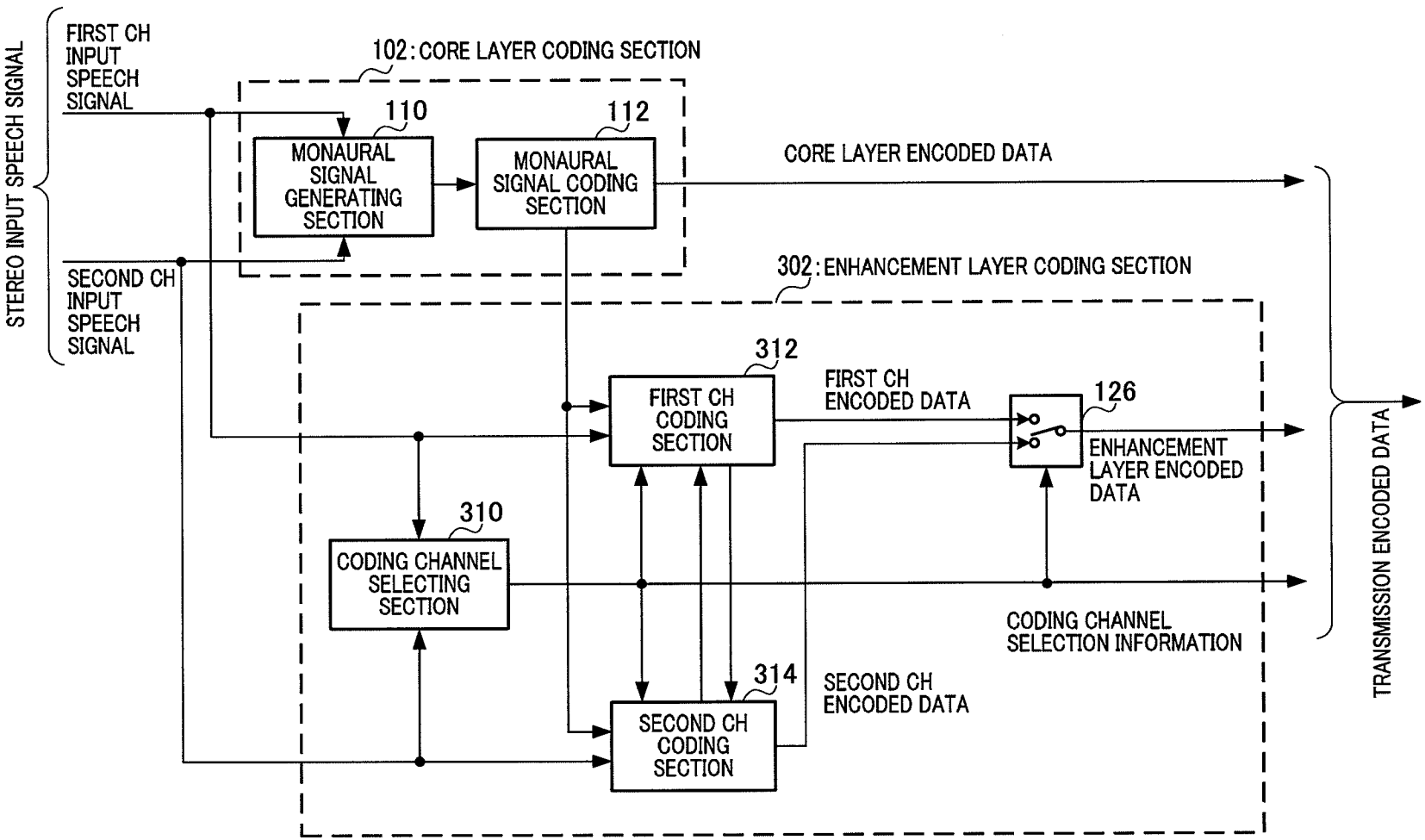
FIG. 4 is a block diagram showing a configuration of speech coding apparatus according to Embodiment 3 of the present invention.

FIG. 4 is a block diagram showing a configuration of speech coding apparatus according to Embodiment 3 of the present invention. Speech coding apparatus 300 of FIG. 4 has basically the same configuration as speech coding apparatus 100 and 200 described in the above embodiments. Elements of this configuration described in this embodiment that are the same as described for the aforementioned embodiments are given the same reference numerals as are used in the aforementioned embodiments and are not described in detail.

Further, transmitted coded data sent from speech coding apparatus 300 can be decoded by speech decoding apparatus having the same basic configuration as speech decoding apparatus 150 described in Embodiment 1.

Speech coding apparatus 300 is equipped with core layer coding section 102 and enhancement layer coding section 302. Enhancement layer coding section 302 is comprised of coding channel selecting section 310, first ch coding section 312, second ch coding section 314 and switching section 126.

Figure 5:
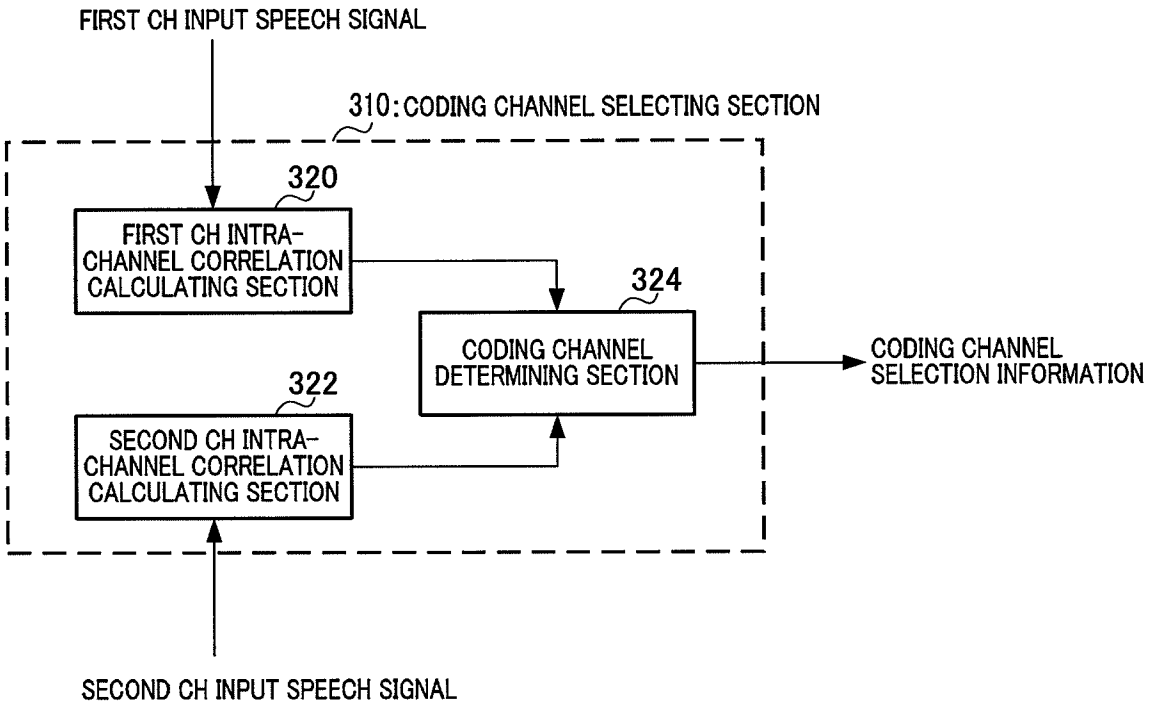
FIG. 5 is a block diagram showing a configuration of coding channel selecting section according to Embodiment 3 the present invention.

As shown in FIG. 5, coding channel selecting section 310 is comprised of first ch intra-channel correlation calculating section 320, second ch intra-channel correlation calculating section 322, and coding channel determining section 324.

First ch intra-channel correlation calculating section 320 calculates first channel intra-channel correlation cor1 using a normalized maximum autocorrelation factor with respect to first ch input speech signal.

Second ch intra-channel correlation calculating section 322 calculates second channel intra-channel correlation cor2 using a normalized maximum autocorrelation factor with respect to second ch input speech signal.

It is also possible to use pitch prediction gain with respect to inputted speech signals for each channel or maximum autocorrelation factor with respect to LPC (Linear Prediction Coding) prediction error signals and pitch prediction gain values in place of normalized maximum autocorrelation factor with respect to inputted speech signals for each channel for the calculation of intra-channel correlation for each channel.

Coding channel determining section 324 compares intra-channel correlation cor1 and cor2 and selects the one having the higher value. Coding channel determining section 324 selects a channel corresponding to intra-channel correlation of the selected channel as a coding channel at the enhancement layer, and generates coding channel selection information indicating the selected channel. More specifically, coding channel determining section 324 selects the first channel when intra-channel correlation cor1 is higher than intra-channel correlation cor2, and selects the second channel when intra-channel correlation cor2 is higher than intra-channel correlation cor1. Generated coding channel selection information is outputted to switching section 126 and is multiplexed with core layer encoded data and enhancement layer encoded data.

Figure 6:
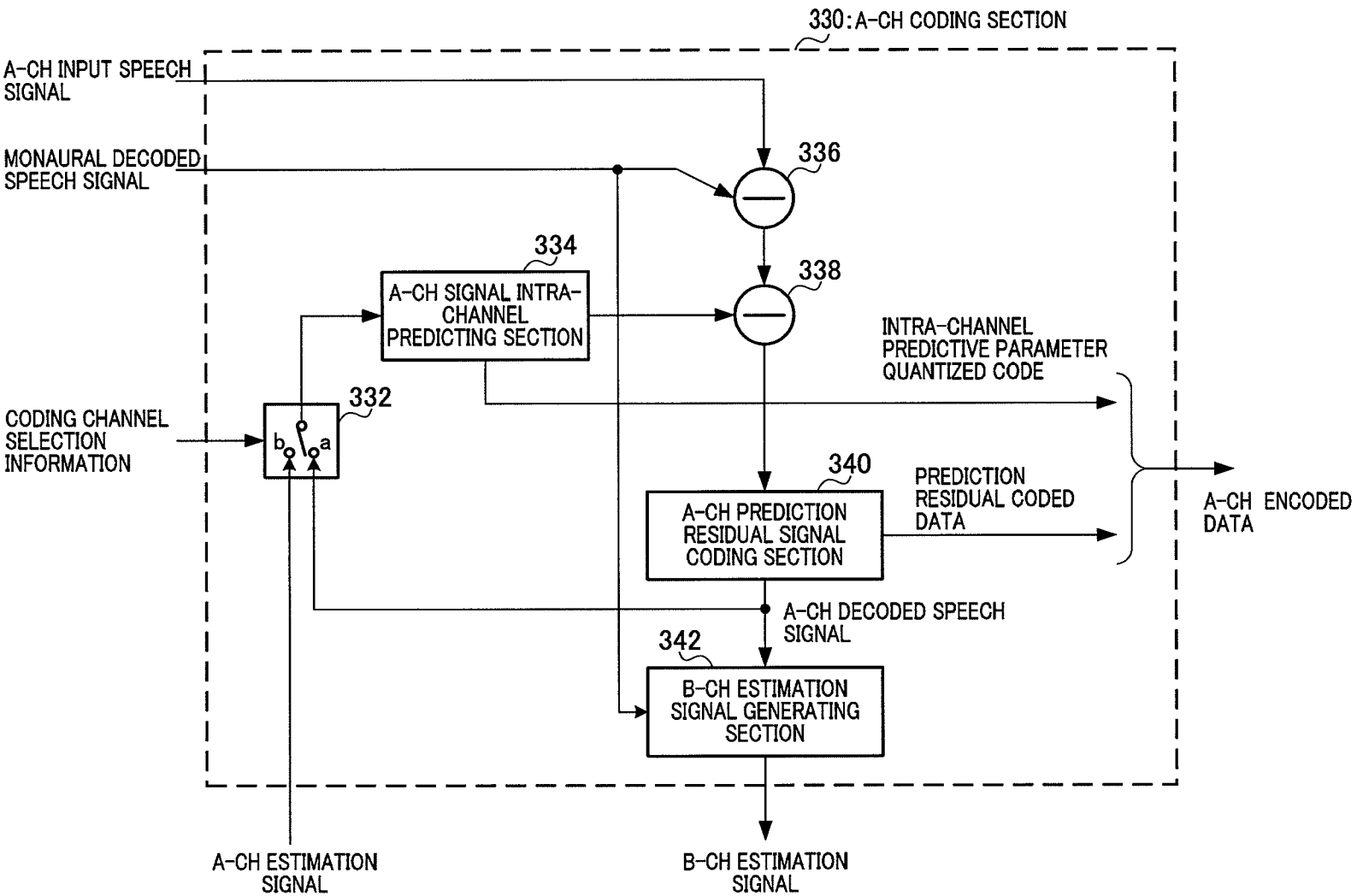
FIG. 6 is a block diagram showing a configuration of an A-ch coding section according to Embodiment 3 of the present invention.

First ch coding section 312 and second ch coding section 314 have the same internal configuration. For ease of description, one of first ch coding section 312 and second ch coding section 314 is shown as "A-ch coding section 330", and its internal configuration is described using FIG. 6. "A" of "A-ch" is 1 or 2. Further, "B" in the drawings and used in the following description also is 1 or 2. When "A" is 1, "B" is 2, and when "A" is 2, "B" is 1.

A-ch coding section 330 is comprised of switching section 332, A-ch signal intra-channel predicting section 334, subtractors 336 and 338, A-ch prediction residual signal coding section 340, and B-ch estimation signal generating section 342.

Switching section 332 outputs an A-ch decoded speech signal obtained by A-ch prediction residual signal coding section 340 or A-ch estimation signal obtained by B-ch coding section (not shown) to A-ch signal intra-channel predicting section 334 in accordance with coding channel selection information. Specifically, when the selected channel is an A-channel, an A-ch decoded speech signal is outputted to A-ch signal intra-channel predicting section 334, and when the selected channel is a B-channel, the A-ch estimation signal is outputted to A-ch signal intra-channel predicting section 334.

A-ch signal intra-channel predicting section 334 carries out intra-channel prediction for the A-channel. Intra-channel prediction is for predicting the signal of the current frame from a signal of a past frame by utilizing correlation of signals within a channel. An intra-channel prediction signal Sp(n) and intra-channel predictive parameter quantized code are obtained as intra-channel prediction results. For example, when a $1^{st}$-order pitch prediction filter is used, intra-channel prediction signal Sp(n) is calculated using the following equation 4.

(Equation 4)

$$Sp(n)=gp\times Sin(n-T) \quad [4]$$

Here, Sin(n) is an inputted signal to a pitch prediction filter, T is lag of a pitch prediction filter, and gp is a pitch prediction coefficient for a pitch prediction filter.

A signal for a past frame as described above is held in an intra-channel prediction buffer (A-ch intra-channel prediction buffer) provided inside A-ch signal intra-channel predicting section 334. Further, the A-ch intra-channel prediction buffer is updated using the signal inputted by switching section 332 in order to predict the signal for the next frame. The details of updating the intra-channel prediction buffer are described in the following.

Subtractor 336 subtracts the monaural decoded speech signal from an A-ch input speech signal. Subtractor 338 subtracts intra-channel prediction signal Sp(n) obtained as a result of intra-channel prediction at A-ch signal intra-channel predicting section 334 from a signal obtained by subtract at subtractor 336. The signal obtained by subtraction at subtractor 338 (i.e. an A-ch prediction residual signal), is outputted to A-ch prediction residual signal coding section 340.

A-ch prediction residual signal coding section 340 encodes the A-ch prediction residual signal using an arbitrary coding method. Prediction residual coded data and an A-ch decoded speech signal are obtained as a result of this encoding. Prediction residual coded data is outputted as A-ch encoded data together with intra-channel predictive parameter quantized code. The A-ch decoded speech signal is outputted to B-ch estimation signal generating section 342 and switching section 332.

B-ch estimation signal generating section 342 generates a B-ch estimation signal as a B-ch decoded speech signal for the case of encoding the A channel from the A-ch decoded speech signal and the monaural decoded speech signal. The generated B-ch estimation signal is then outputted to a switching section (same as switching section 332) of the B-ch coding section (not shown).

Next, a description is given of the operation of updating an intra-channel prediction buffer. Here, the case where the A-channel is selected by coding channel selecting section 310 is taken as an example, an example of an operation for updating the A-channel intra-channel prediction buffer is described using FIG. 7, and an example of an operation for updating the B-channel intra-channel prediction buffer is described using FIG. 8.

Figure 7:
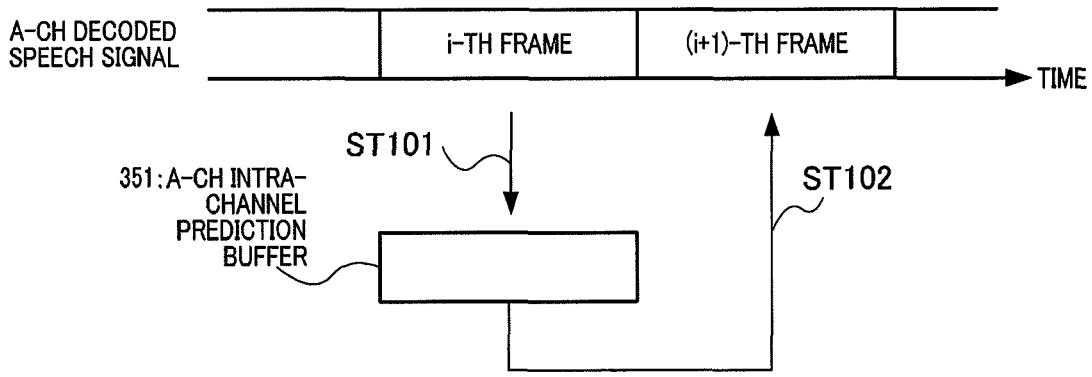
FIG. 7 is a view illustrating an example of an updating operation for an intra-channel prediction buffer of an A-channel according to Embodiment 3 of the present invention.

In the example operation shown in FIG. 7, the A-ch intra-channel prediction buffer 351 for within the A-ch signal intra-channel predicting section 334 is updated using an A-ch decoded speech signal for the i-th frame (where i is an arbitrary natural number) obtained by A-ch prediction residual signal coding section 340 (ST101) The updated A-ch intra-channel prediction buffer 351 can then be used in intra-channel prediction for the (i+1)-th frame that is the next frame (ST102).

Figure 8:
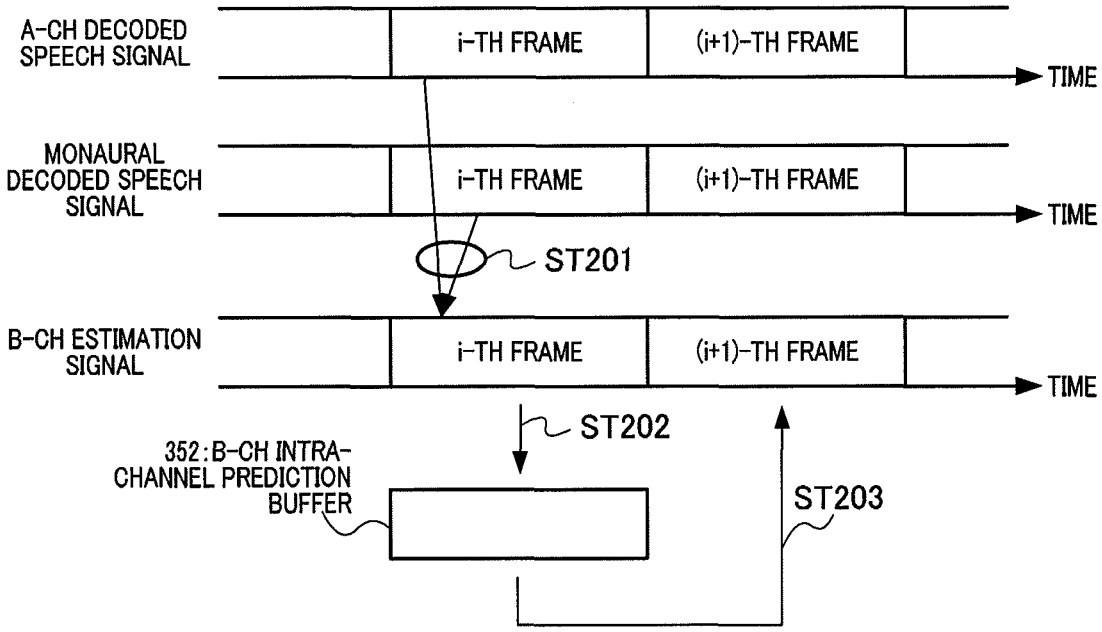
FIG. 8 is a view illustrating an example of an updating operation for an intra-channel prediction buffer of a B-channel according to Embodiment 3 of the present invention.

In the example operation shown in FIG. 8, an i-th frame B-ch estimation signal is generated using an i-th frame A-ch decoded speech signal and an i-th frame monaural decoded speech signal (ST201). The generated B-ch prediction signal is then outputted to a B-ch coding section (not shown) from A-ch coding section 330. At the B-ch coding section, the B-ch prediction signal is outputted to the B-ch signal intra-channel predicting section (the same as A-ch signal intra-channel predicting section 334) via a switching section (the same as switching section 332). B-ch intra-channel prediction buffer 352 provided inside B-ch signal intra-channel predicting section is updated using a B-ch estimation signal (ST202). The updated B-ch intra-channel prediction buffer 352 can then be used in intra-channel prediction for the (i+1)-th frame (ST203).

At a certain frame, when the A-channel is selected as a coding channel, operations other than updating of B-ch intra-channel prediction buffer 352 are not necessary at the B-ch coding section, therefore it is possible to suspend coding of the B-ch input speech signal for this frame.

According to this embodiment, the degree of intra-channel correlation is used as a coding channel selection criterion, so that it is possible to encode channels where intra-channel correlation is high and improve coding efficiency using intra-channel prediction.

Components for executing inter-channel prediction can be added to the configuration of A-ch coding section 330. In this case, a configuration may be adopted where, rather than inputting a monaural decoded speech signal to subtractor 336, A-ch coding section 330 carries out inter-channel prediction for predicting an A-ch speech signal using a monaural decoded speech signal, and an inter-channel prediction signal generated as a result is then inputted to subtractor 336.

Embodiment 4

Figure 9:
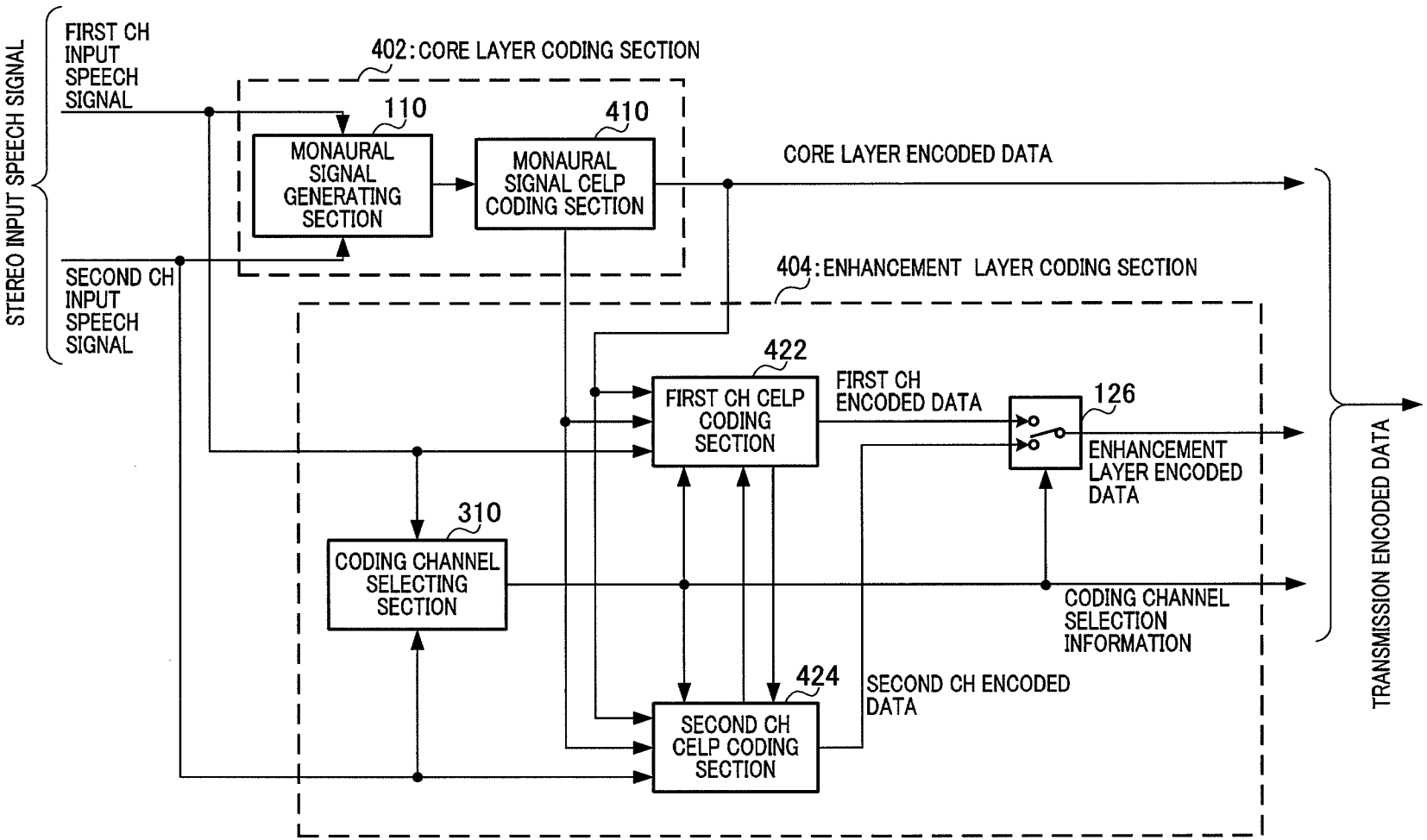
FIG. 9 is a block diagram showing a configuration of speech coding apparatus according to Embodiment 4 of the present invention.

FIG. 9 is a block diagram showing a configuration of speech coding apparatus according to Embodiment 4 of the present invention.

Speech coding apparatus 400 of FIG. 9 has basically the same configuration as speech coding apparatus 100, 200, and 300 described in the above embodiments. Elements of this configuration described in this embodiment that are the same as described for the aforementioned embodiments are given the same reference numerals as are used in the aforementioned embodiments and are not described in detail.

Further, transmitted coded data sent from speech coding apparatus 400 can be decoded by speech decoding apparatus having the same basic configuration as speech decoding apparatus 150 described in Embodiment 1.

Speech coding apparatus 400 is equipped with core layer coding section 402 and enhancement layer coding section 404. Core layer coding section 402 has monaural signal generating section 110 and monaural signal CELP (Code Excited Linear Prediction) coding section 410. Enhancement layer coding section 404 is comprised of coding channel selecting section 310, first ch CELP coding section 422, second ch CELP coding section 424 and switching section 126.

At core layer coding section 402, monaural signal CELP coding section 410 carries out CELP coding on a monaural signal generated by monaural signal generating section 110. Coded data obtained as a result of this coding is outputted as core layer encoded data. Further, a monaural excitation signal is obtained as a result of this coding. Moreover, monaural signal CELP coding section 410 decodes the monaural signal and outputs a monaural decoded speech signal obtained as a result. Core layer encoded data is multiplexed with enhancement layer encoded data and coding channel selection information. Further, core layer encoded data, a monaural excitation signal and a monaural decoded speech signal are outputted to first ch CELP coding section 422 and second ch CELP coding section 424.

Figure 10:
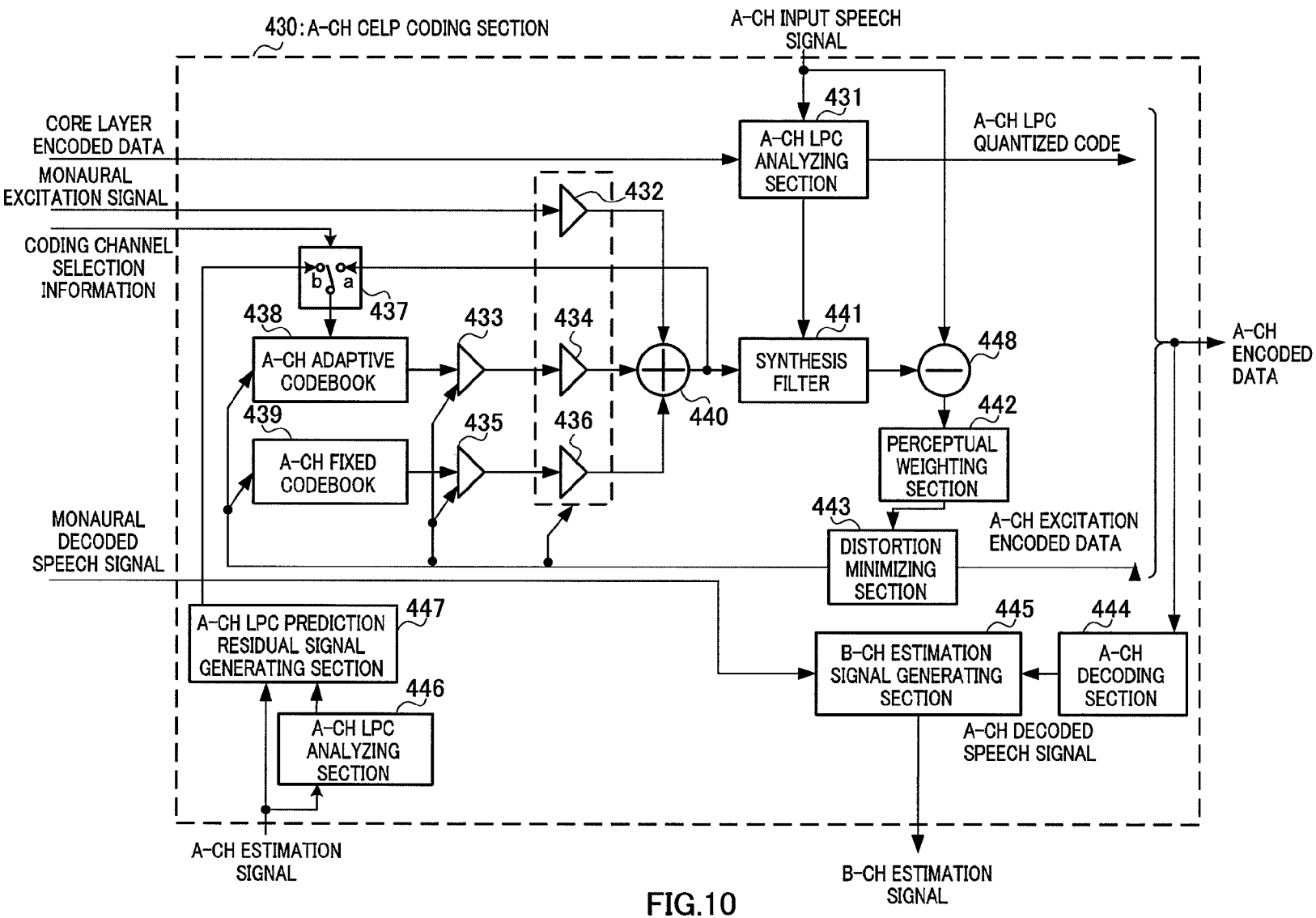
FIG. 10 is a block diagram showing a configuration of an A-ch CELP coding section according to Embodiment 4 of the present invention.

At enhancement layer coding section 404, first ch CELP coding section 422 and second ch CELP coding section 424 have the same internal configuration. For ease of description, one of first ch CELP coding section 422 and second ch CELP coding section 424 is shown as "A-ch CELP coding section 430", and its internal configuration is described using FIG. 10. As described above, "A" of "A-ch" is 1 or 2, "B" used in the drawings and in the following description is "1" or "2." When "A" is 1, "B" is 2, and, when "A" is 2, "B" is 1.

A-ch CELP coding section 430 is comprised of A-ch LPC (Linear Prediction Coding) analyzing section 431, multipliers 432, 433, 434, 435, and 436, switching section 437, A-ch adaptive codebook 438, A-ch fixed codebook 439, adder 440, synthesis filter 441, perceptual weighting section 442, distortion minimizing section 443, A-ch decoding section 444, B-ch estimation signal generating section 445, A-ch LPC analyzing section 446, A-ch LPC prediction residual signal generating section 447, and subtractor 448.

At A-ch CELP coding section 430, A-ch LPC analyzing section 431 carries out LPC analysis on the A-ch inputted speech signal and quantizes an A-ch LPC parameter obtained as a result. Upon quantizing of LPC parameters, A-ch LPC analyzing section 431 decodes monaural signal quantized LPC parameters from core layer encoded data, quantizes a differential component of the A-ch LPC parameter with respect to the decoded monaural signal quantized LPC parameter, and obtains A-ch LPC quantized code so as to utilize the fact that correlation between the A-ch LPC parameter and the LPC parameters for the monaural signal is typically high. The A-ch LPC quantized code is outputted to synthesis filter 441. Further, A-ch LPC quantized code is outputted as A-ch encoded data together with A-ch excitation coded data described later. It is therefore possible to make quantizing of the enhancement layer LPC parameter efficient by quantizing a differential component.

At A-ch CELP coding section 430, A-ch excitation coding data is obtained by coding a residual component with respect to the monaural excitation signal of the A-ch excitation signal. This coding is implemented using excitation search occurring in CELP coding.

Namely, at A-ch CELP coding section 430, an adaptive excitation signal, fixed excitation signal, and monaural excitation signal are respectively multiplied with corresponding gains, with excitation signals being added after gain multiplication. Closed loop type excitation search (adaptive codebook search, fixed codebook search, and gain search) by distortion minimizing is then carried out on excitation signals obtained as a result of this addition. An adaptive codebook index (adaptive excitation index), fixed codebook index (fixed excitation index), and gain code for an adaptive excitation signal, fixed excitation signal, and monaural excitation signal are then outputted as A-ch excitation coded data. This excitation search is carried out every sub-frame obtained by dividing frames into a plurality of portions, whereas core layer coding, enhancement layer coding, and coding channel selection is carried out every frame. A detailed description is given of this configuration in the following.

Synthesis filter 441 carries out synthesis using the LPC synthesis filter taking a signal outputted by adder 440 as an excitation using A-ch LPC quantizing code outputted by A-ch LPC analyzing section 431 as an excitation. The synthesis signal obtained as a result of this synthesis is then outputted to subtractor 448.

Subtractor 448 calculates an error signal by subtracting a synthesis signal from the A-ch input speech signal. An error signal is then outputted to perceptual weighting section 442. This error signal corresponds to encoding distortion.

Perceptual weighting section 442 applies perceptual weighting to the coding distortion and outputs coding distortion after weighting to distortion minimizing section 443.

Distortion minimizing section 443 then decides the adaptive codebook index and fixed codebook index in such a manner that coding distortion becomes a minimum, and outputs the adaptive codebook index to A-ch adaptive codebook 438 and the fixed codebook index to A-ch fixed codebook 439. Further, distortion minimizing section 443 generates gains corresponding to these indexes, and, specifically generates gain (adaptive codebook gain and fixed codebook gain) for each of the adaptive vectors described later and fixed vectors described later, and outputs the adaptive codebook gain to multiplier 433 and outputs the fixed codebook gain to multiplier 435.

Moreover, distortion minimizing section 443 generates gains (first adjusting gain, second adjusting gain, and third adjusting gain) for adjusting gain between a monaural excitation signal, an adaptive vector for after gain multiplication and a fixed vector for after gain multiplication, and outputs first adjustment gain to multiplier 432, second adjustment gain to multiplier 434, and third adjustment gain to multiplier 436. The adjustment gains are preferably generated so as to correlate with each other. For example, when there is high inter-channel correlation between the first ch input speech signal and the second ch input speech signal, the three adjustment gains are generated in such a manner that the proportion of the monaural excitation signal becomes relatively large with respect to the proportion of the adaptive vector after gain multiplication and the fixed vector for after gain multiplication. Conversely, when there is low inter-channel correlation, the three adjustment gains are generated in such a manner that the proportion of the monaural excitation signal becomes relatively small with respect to the proportion of the adaptive vector after gain multiplication and the fixed vector for after gain multiplication.

Further, distortion minimizing section 443 outputs the adaptive codebook index, fixed codebook index, code for the adaptive codebook gain, code for the fixed codebook gain, and code for the three gain adjustment gains, as A-ch excitation coded data.

A-ch adaptive codebook 438 stores excitation vectors generated in the past used as excitations to synthesis filter 441 to an internal buffer. Further, A-ch adaptive codebook 438 generates one sub-frame portion of vectors from stored excitation vectors as adaptive vectors. Generation of adaptive vectors is carried out based on adaptive codebook lag (pitch lag or pitch period) corresponding to an adaptive codebook index inputted by distortion minimizing section 443. Generated adaptive vectors are then outputted to multiplier 433.

The internal buffer of A-ch adaptive codebook 438 is then updated using a signal outputted by switching section 437. The details of this updating operation are described in the following.

A-ch fixed codebook 439 outputs excitation vectors corresponding to fixed codebook indexes outputted by distortion minimizing section 443 to multiplier 435 as fixed vectors.

Multiplier 433 multiplies adaptive codebook gain upon adaptive vectors outputted by A-ch adaptive codebook 438 and outputs adaptive vectors for after gain multiplication to multiplier 434.

Multiplier 435 multiplies fixed codebook gain upon adaptive vectors outputted by A-ch fixed codebook 439 and outputs fixed vectors for after gain multiplication to multiplier 436.

Multiplier 432 multiplies the monaural excitation signal by the first adjustment gain, and outputs the monaural excitation signal for after gain multiplication to adder 440. Multiplier 434 multiplies adaptive vectors outputted by multiplier 433 by the second adjustment gain, and outputs adaptive vectors for after gain multiplication to adder 440. Multiplier 436 multiplies fixed vectors outputted by multiplier 435 by the third adjustment gain, and outputs fixed vectors for after gain multiplication to adder 440.

Adder 440 adds a monaural excitation signal outputted by multiplier 432, an adaptive vector outputted by multiplier 434, and a fixed vector outputted by multiplier 436, and outputs the signal after addition to switching section 437 and synthesis filter 441.

Switching section 437 outputs a signal outputted by adder 440 or a signal outputted by A-ch LPC prediction residual signal generating section 447 to A-ch adaptive codebook 438 in accordance with coding channel selection information. More specifically, when the selected channel is the A-channel, a signal from adder 440 is outputted to A-ch adaptive codebook 438, and, when the selected channel is the B-channel, a signal from A-ch LPC prediction residual signal generating section 447 is outputted to A-ch adaptive codebook 438.

A-ch decoding section 444 decodes the A-ch coding data, and outputs an A-ch decoded speech signal obtained as a result to B-ch estimation signal generating section 445.

B-ch estimation signal generating section 445 generates a B-ch estimation signal as a B-ch decoded speech signal for the case of A-ch coding using the A-ch decoded speech signal and the monaural decoded speech signal. The generated B-ch estimation signal is then outputted to B-ch CELP coding section (not shown).

A-ch LPC analyzing section 446 carries out LPC analysis on the A-ch estimation signal outputted by the B-ch CELP coding section (not shown) and outputs A-ch LPC parameters obtained as a result to A-ch LPC prediction residual signal generating section 447. Here, the A-ch estimation signal outputted by the B-ch CELP coding section corresponds to the A-ch decoded speech signal generated when the B-ch input speech signal is encoded at the B-ch CELP coding section (at the case of B-ch coding).

A-ch LPC prediction residual signal generating section 447 generates a coded LPC prediction residual signal for the A-ch estimation signal using the A-ch LPC parameters outputted by A-ch LPC analyzing section 446. The generated coded LPC prediction residual signal is outputted to switching section 437.

Figure 11:
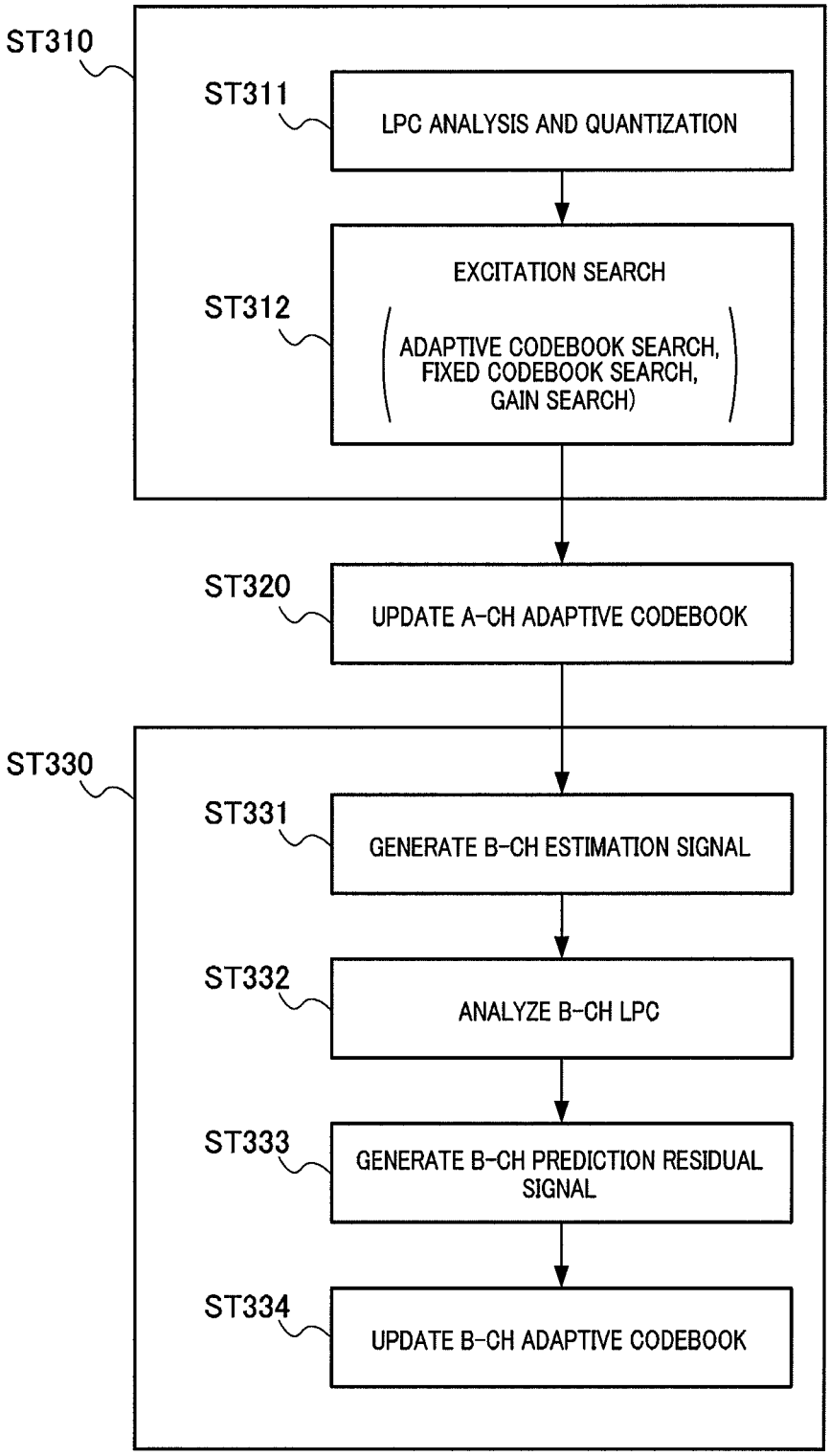
FIG. 11 is a flowchart showing an example of an adaptive codebook updating operation according to Embodiment 4 of the present invention.

Next, a description is given of the operation of updating the adaptive codebook at A-ch CELP coding section 430 and the B-ch CELP coding section (not shown). FIG. 11 is a flowchart showing an adaptive codebook updating operation for when channel A is selected by coding channel selecting section 310.

The flow of the example shown here is divided into CELP coding processing at A-ch CELP coding section 430 (ST310), update processing of the adaptive codebook within A-ch CELP coding section 430 (ST320), and update processing an adaptive codebook within the B-ch CELP coding section (ST330). Further, step ST310 includes two steps ST311 and ST312, and step ST330 includes four steps ST331, ST332, ST333, and ST334.

First, in step ST311, LPC analysis and quantizing is carried out by A-ch LPC analysis section 431 of A-ch CELP coding section 430. Excitation search (adaptive codebook search, fixed codebook search, and gain search) is then carried out by a closed loop type excitation search section mainly containing A-ch adaptive codebook 438, A-ch fixed codebook 439, multipliers 432, 433, 434, 435, and 436, adder 440, synthesis filter 441, subtractor 448, perceptual weighting section 442, and distortion minimizing section 443 (ST312).

In step ST320, an internal buffer of A-ch adaptive codebook 438 is updated using an A-ch excitation signal obtained by the aforementioned excitation search.

In step ST331, a B-ch estimation signal is generated by B-ch estimation signal generating section 445 of A-ch CELP coding section 430. The generated B-ch estimation signal is sent to B-ch CELP coding section from A-ch CELP coding section 430. In step ST332, LPC analysis is carried out on the B-ch estimation signal by B-ch LPC analyzing section (the same as the A-ch LPC analyzing section 446) of B-ch CELP coding section (not shown), so as to obtain a B-ch LPC parameter.

In step ST333, a B-ch LPC parameter is used by a B-ch LPC prediction residual signal generating section (same as the A-ch LPC prediction residual signal generating section 447) of the B-ch CELP coding section (not shown) and a coded LPC prediction residual signal is generated for the B-ch estimation signal. This encoded LPC prediction residual signal is outputted to a B-ch adaptive codebook (the same as A-ch adaptive codebook 438) (not shown) via a switching section (the same as switching section 437) of B-ch CELP coding section (not shown). In step ST334, the internal buffer of the B-ch adaptive codebook is updated using the coded LPC prediction residual signal for the B-ch estimation signal.

A more detailed description is given in the following of the operation of updating the adaptive codebook. Here, the case where the A-channel is selected by coded channel selecting section 310 is taken as an example, an example of an operation for updating an internal buffer of A-ch adaptive codebook 438 is described using FIG. 12, and an example of an operation for updating an internal buffer of the B-channel adaptive codebook is described using FIG. 13.

Figure 12:
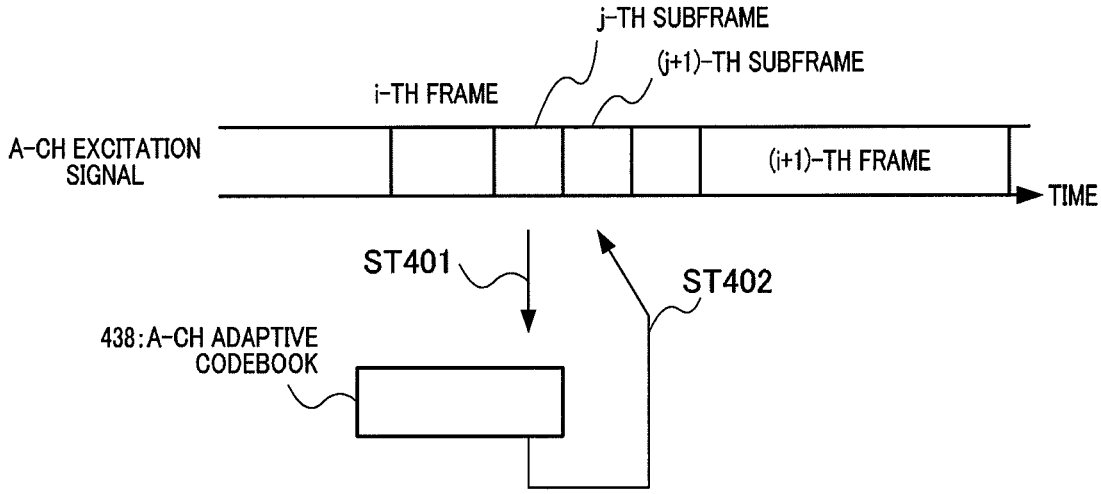
FIG. 12 is a view illustrating an example of an operation for updating an A-ch adaptive codebook according to Embodiment 4 of the present invention.

In the operating example shown in FIG. 12, the internal buffer of the A-ch adaptive codebook 438 is updated using the A-ch excitation signal for the j-th subframe within the i-th frame obtained by distortion minimizing section 443 (ST401). The updated A-ch adaptive codebook 438 is used in excitation search for the (j+1)-th subframe that is the next subframe (ST402).

Figure 13:
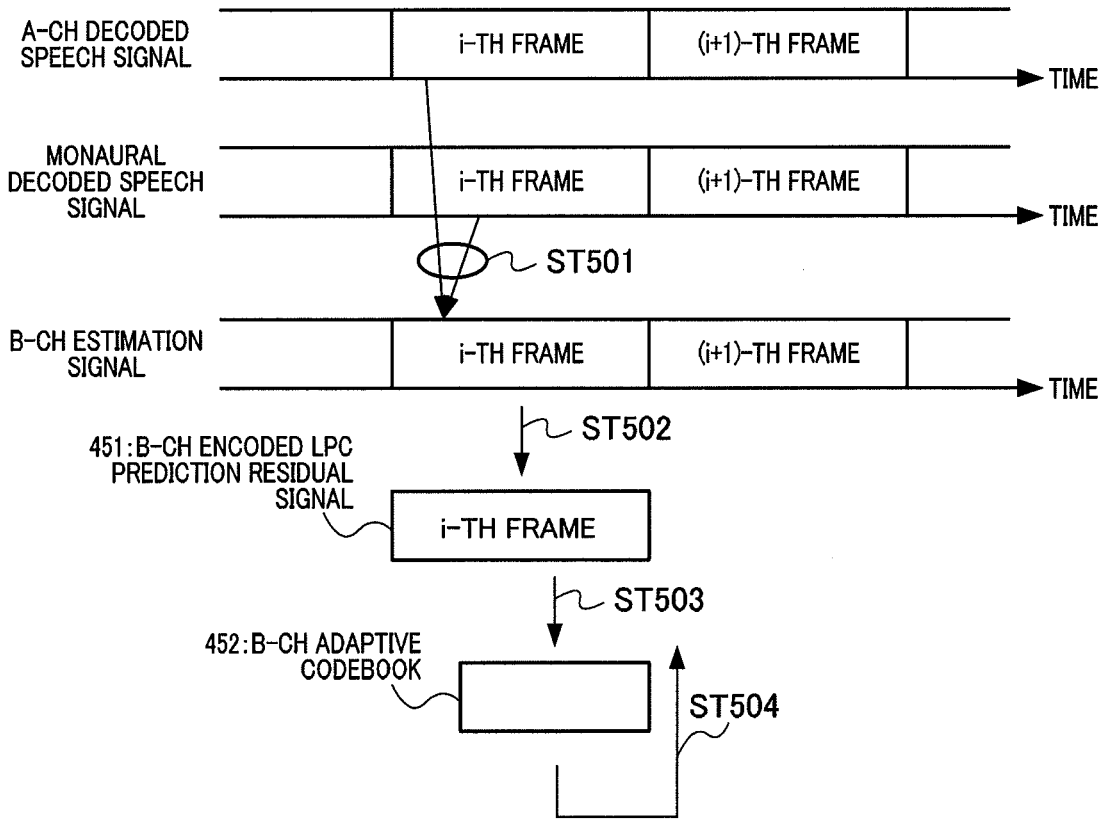
FIG. 13 is a view illustrating an example of an operation for updating a B-ch adaptive codebook according to Embodiment 4 of the present invention.

In the example operation shown in FIG. 13, an i-th frame B-ch estimation signal is generated using an i-th frame A-ch decoded speech signal and an i-th frame monaural decoded speech signal (ST501). The generated B-ch estimation signal is outputted to B-ch CELP coding section from A-ch CELP coding section 430. The B-ch encoded LPC prediction residual signal (coded LPC prediction residual signal for the B-ch estimation signal) 451 for the i-th frame is then generated for the B-ch LPC prediction residual signal generating section of the B-ch CELP coding section (ST502). B-ch coded LPC prediction residual signal 451 is outputted to B-ch adaptive codebook 452 via the switching section of the B-ch CELP coding section. B-ch adaptive codebook 452 is then updated by B-ch encoded LPC prediction residual signal 451 (ST503). The updated B-ch adaptive codebook 452 can then be used in excitation search of the (i+1)-th frame that is the next frame (ST504).

At a certain frame, when the A-channel is selected as a coding channel, operations other than updating of B-ch adaptive codebook 452 are not necessary at the B-ch CELP coding section, therefore it is possible to suspend coding of the B-ch input speech signal for this frame.

In this way, according to this embodiment, it is possible to encode signals for channels where intra-channel correlation is high in cases where speech coding is carried out for each layer based on CELP coding methods, and it is possible to improve the coding efficiency using intra-channel prediction.

In this embodiment, a description is given of an example of the case of using coding channel selecting section 310 described in Embodiment 3 at the speech coding apparatus adopting the CELP coding method but it is also possible to use the coding channel selecting section 120 and the coding channel selecting section 210 described for Embodiment 1 and Embodiment 2, respectively, in place of the coding channel selecting section 310 or together with the coding channel selecting section 310. It is therefore possible to effectively implement each of the embodiments described above in the case of carrying out speech coding of each layer based on CELP coding methods.

Further, it is also possible to use that other than that described above as a selection criterion for enhancement layer encoded channels. For example, adaptive codebook search of an A-ch CELP coding section 430 and adaptive codebook search of a B-ch CELP coding section are respectively carried out, and the channel corresponding to that having the smaller value of the coding distortion obtained as these results may then be selected as the coding channel.

Further, the components executing inter-channel prediction can be added to the configuration of A-ch CELP coding section 430. In this case, a configuration may be adopted where rather than directly multiplying the monaural excitation signal with the first adjusting gain, A-ch CELP coding section 430 carries out inter-channel prediction estimating A-ch decoded speech signal using the monaural excitation signal and then multiplies the first adjusting gain with an inter-channel prediction signal generated as a result.

The above is a description of each of the embodiments of the present invention. The speech coding apparatus and speech decoding apparatus of each of the embodiments described above can also be mounted on wireless communication apparatus such as wireless communication mobile station apparatus and wireless communication base station apparatus etc. used in mobile communication systems.

Further, a description is given in the above embodiments of an example of the case where the present invention is configured using hardware but the present invention may also be implemented using software.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", "system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese patent application No. 2005-132366, filed on Apr. 28, 2005, the entire content of which is expressly incorporated herein by reference.

INDUSTRIAL APPLICABILITY

The present invention may also be put to use in mobile communication systems and communication apparatus such as packet communication systems etc. employing internet protocols.

The invention claimed is:

1. A speech coding apparatus for encoding a stereo signal comprising a first single channel signal and a second single channel signal, the apparatus comprising:

a monaural signal generator, comprising a processor, that generates a monaural signal using the first single channel signal and the second single channel signal;

a selector, comprising a calculator that calculates a first parameter corresponding to the first single channel signal and a second parameter corresponding to the second single channel signal, the selector compares the first calculated parameter and the second calculated parameter to determine whether a criterion for implementing enhancement layer coding at high efficiency or high sound quality, based upon the comparison of the first calculated parameter and the second calculated parameter, is met, selects the first single channel signal if the criterion is met, and selects the second single channel signal if the criterion is not met;

a coder that encodes the generated monaural signal to obtain core layer encoded data, and encodes the selected single channel signal to obtain enhancement layer encoded data corresponding to the core layer encoded data; and an outputter that outputs encoded data so that the encoded data is transmitted to speech decoding apparatus, wherein:

the enhancement layer encoded data do not contain encoded data of an unselected single channel signal; and the encoded data includes selection information that represents which of the single channel signals the selector selected, the core layer encoded data and the enhancement layer encoded data.

2. The speech coding apparatus of claim 1, wherein:

the selector selects one of the first single channel signal and the second single channel signal every frame; and the coder encodes the monaural signal and the single channel signal selected every frame, every frame.

3. The speech coding apparatus of claim 1, wherein the calculator calculates a first coding distortion occurring when the first single channel signal is selected and a second coding distortion occurring when the second single channel signal is selected, wherein the selector selects the first single channel signal when the calculated first coding distortion is smaller than the calculated second coding distortion, and selects the second single channel signal when the calculated second coding distortion is smaller than the calculated first coding distortion.

4. The speech coding apparatus of claim 3, wherein the coder encodes the first single channel signal and the second single channel signal to obtain first coded data and second coded data, respectively, and outputs one of the first coded data and the second coded data corresponding to the selected single channel signal as the enhancement layer encoded data, and comprises:

an estimation signal generator that generates a second channel estimation signal corresponding to the second channel using a monaural decoded signal obtained when the coder encodes the monaural signal and a first channel decoded signal obtained when the coder encodes the first single channel signal, and generates a first channel estimation signal corresponding to the first single channel signal using the monaural decoded signal and a second channel decoded signal obtained when the coder encodes the second single channel signal; and a distortion calculator that calculates the first coding distortion based on error of the first channel decoded signal with respect to the first single channel signal and error of the second channel estimation signal with respect to the second single channel signal, and calculates second coding distortion based on error of the first channel estimation signal with respect to the first single channel signal and error of the second channel decoding signal with respect to the second single channel signal.

5. The speech coding apparatus of claim 1, wherein the calculator that calculates a first intra-channel correlation corresponding to the first single channel signal and a second intra-channel correlation corresponding to the second single channel signal, selects the first single channel signal when the calculated first intra-channel correlation is greater than the calculated second intra-channel correlation, and selects the second single channel signal when the calculated second intra-channel correlation is greater than the calculated first intra-channel correlation.

6. The speech coding apparatus of claim 1, wherein the coder carries out code excited linear prediction coding of the first single channel signal using a first adaptive codebook when the first single channel signal is selected by the selector, obtains the enhancement layer encoded data using code excited linear prediction coding results and updates the first adaptive codebook using the code excited linear prediction coding results.

7. The speech coding apparatus of claim 6, wherein the coder generates a second channel estimation signal corresponding to the second single channel signal using the enhancement layer encoded data and a monaural decoded signal obtained when the monaural signal is encoded, and updates the second adaptive codebook used in code excited linear prediction coding of the second single channel signal using an linear prediction coding prediction residual signal for the second channel estimation signal.

8. The speech coding apparatus of claim 7, wherein:

the selector correlates the first single channel signal to a frame having a subframe and selects the first single channel signal; and the coder obtains the enhancement layer encoded data for the frame while carrying out excitation search every subframe for the monaural signal and the first single channel signal correlated with the frame and selected.

9. The speech coding apparatus of claim 8, wherein the coder updates the first adaptive codebook per subframe and updates the second adaptive codebook per frame.

10. A mobile station apparatus comprising the speech coding apparatus of claim 1.

11. A base station apparatus comprising the speech coding apparatus of claim 1.

12. A speech coding method for encoding a stereo signal comprising a first single channel signal and a second single channel signal, the method comprising:

generating a monaural signal using the first single channel signal and the second single channel signal;

calculating a first parameter corresponding to the first single channel signal and a second parameter corresponding to the second single channel signal;

comparing the first calculated parameter and the second calculated parameter to determine whether a criterion for implementing enhancement layer coding at high efficiency or high sound quality, based upon the comparison of the first calculated parameter and the second calculated parameter, is met;

selecting the first single channel signal if the criterion is met;

selecting the second single channel signal if the criterion is not met;

encoding a generated monaural signal to obtain core layer encoded data and encoding a selected single channel signal to obtain enhancement layer encoded data corresponding to the core layer encoded data; and outputting encoded data so that the encoded data is transmitted to a speech decoding apparatus, wherein:

the enhancement layer encoded data do not contain encoded data of an unselected single channel signal; and the encoded data includes selection information that represents which of the single channel signals was selected, the core layer encoded data and the enhancement layer encoded data.

* * * * *